US005842526A

United States Patent [19]

Archer et al.

[11] Patent Number: 5,842,526

[45] Date of Patent: Dec. 1, 1998

[54] SPRINKLER HEAD MOUNTING SYSTEM

[76] Inventors: Robert C. Archer, 8609 SE. Lambert, Portland, Oreg. 97266; Paul Clark, 3323 SE. 182nd Ave., Gresham, Oreg. 97030

[21] Appl. No.: 533,920

[22] Filed: Sep. 26, 1995

[51] Int. Cl.[6] ..... A62C 39/68

[52] U.S. Cl. ..... 169/56; 169/37; 285/410; 285/411

[58] Field of Search ..... 169/16, 37, 56; 285/410, 411

[56] References Cited

U.S. PATENT DOCUMENTS

| | | | |
|---|---|---|---|
| 2,890,758 | 6/1959 | Pfalzgraff et al. | 169/37 |
| 3,728,866 | 4/1973 | Layton . | |
| 3,854,388 | 12/1974 | King . | |
| 4,211,735 | 7/1980 | Berlin . | |
| 4,508,555 | 4/1985 | Baduel . | |
| 4,568,115 | 2/1986 | Zimmerly | 285/411 |
| 4,657,284 | 4/1987 | Fiori | 285/410 |
| 4,739,542 | 4/1988 | Krzesicki | 285/411 |
| 4,834,186 | 5/1989 | Ballard | 169/16 |
| 4,919,453 | 4/1990 | Halling et al. | 285/411 |
| 4,964,470 | 10/1990 | Gaulin . | |
| 4,964,471 | 10/1990 | Michalik et al. | 169/37 |
| 5,327,976 | 7/1994 | Hattori | 169/16 |

FOREIGN PATENT DOCUMENTS

| | | | |
|---|---|---|---|
| 3919638 | 11/1990 | Germany | 169/16 |
| 89299 | 8/1978 | Japan | 169/16 |

*Primary Examiner*—Gary C. Hoge

[57] ABSTRACT

A combination duct/extinguishing system includes a duct and plural sprinkler head assembly and mounting systems on the duct. Each sprinkler head assembly and mounting system includes port structure mounted on the duct defining a passageway into an area internally of the duct, sprinkler head structure having one end associated with a corresponding port structure, and another end associated with an extinguishing media, and collar structure for removable engaging the port structure and the sprinkler head structure to fixedly hold the sprinkler head in the area internally of the duct. Preferably, the collar structure includes two halves hingedly joined, each having wall structure defining a groove for receiving a portion of the port structure and the sprinkler head structure.

6 Claims, 2 Drawing Sheets

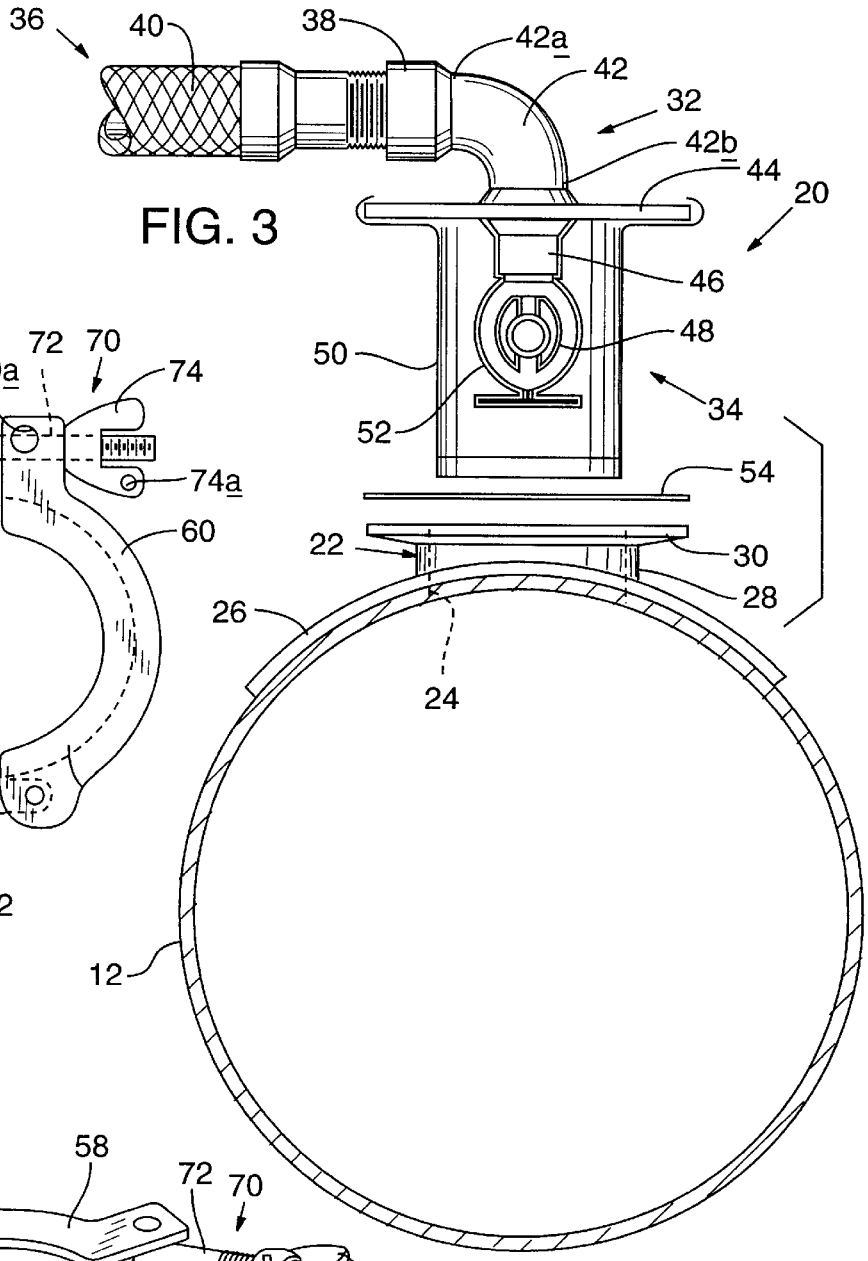
FIG. 3
FIG. 4
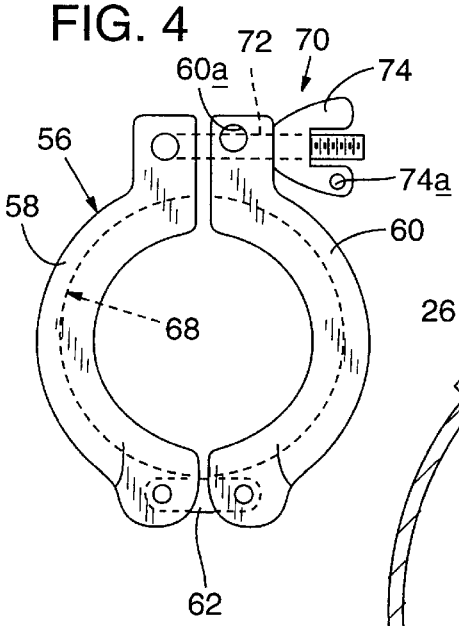
FIG. 5
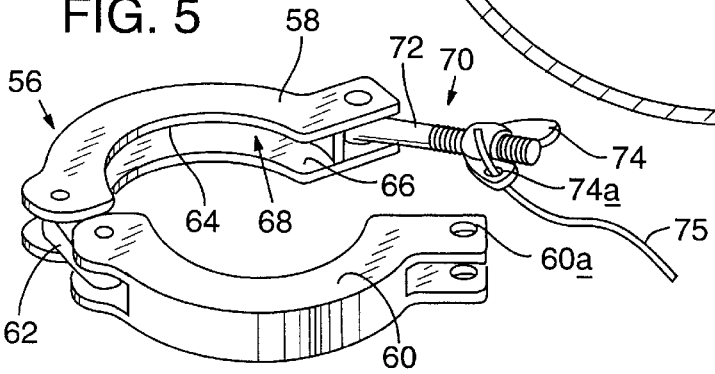

SPRINKLER HEAD MOUNTING SYSTEM

BACKGROUND AND SUMMARY OF THE INVENTION

This invention relates generally to sprinkler systems and more specifically it relates to sprinkler head mounting systems.

Sprinkler systems are well known and generally include a sprinkler head mounted to a water-carrying conduit. In the event of a fire, heat-sensing means on the sprinkler head activate the system and water is passed through the sprinkler head to extinguish the fire.

Maintaining sprinkler heads is usually a relatively easy task whereby a service provider will simply inspect the head and the connection for integrity. However, some sprinkler systems, because of the way in which they are mounted and the environments in which they are used, pose a more burdensome, time-consuming inspection requirement. For example, some sprinkler systems are installed in areas where access thereto is limited or impossible. One such area is on a duct which conveys caustic agents or gasses from one location to another. Because of the small diameter of the duct, physical access to the area internally thereof where the sprinkler head is mounted is impossible. Thus, the sprinkler head must be physically removed from the duct in order to properly inspect and service it. An example of such a duct is one which is used in so-called clean rooms in the semiconductor fabrication industry.

During the semiconductor fabrication process, caustic, flammable gasses are produced and become airborne. Such must necessarily be conveyed away to a scrubber area where the gasses are removed from the air and treated. In order to adequately convey the gasses, conduits or ducts are typically installed to provide a passageway for the gasses. Not surprisingly, conveying such caustic gasses gives rise to concerns for the safety of the work environment in the event the gasses should become ignited in the conduit or duct during conveyance. One method of addressing these concerns has been to install sprinkler heads on the conduit, which, in the event of fire, activate to extinguish the flames. Because of the caustic nature of the environment, however, such sprinkler heads must be inspected periodically to ensure that catastrophic corrosion has not occurred. Attempts have been made in the past to provide serviceable sprinkler heads, but such attempts have not fully addressed the need for a dependable, soundly constructed, conveniently serviceable sprinkler head.

One such attempt is described in U.S. Pat. No. 4,964,470 to Gaulin which discloses a sprinkler connection to a scrubber duct which includes a mounting block bolted to a duct by four bolts, and a mounting plate securable to the mounting block by four nuts, each threadably receiving a corresponding bolt. The mounting block and plate are constructed from a fiber-reinforced plastic material, which is undesirable insofar as the plate develops cracks from extended wear. Moreover, over-tightening the nuts as to ensure an extra tight seal tends to crack the mounting plate thereby rendering the system ineffective. In addition to problems stemming from the construction of the mounting plate, there are problems associated with a stainless steel reducer coupling which is permanently bonded to the mounting plate during the manufacture thereof Because the mounting plate is constructed from fiber-reinforced plastic and the reducer coupling is constructed from stainless steel, the mounting plate as a whole is materially non-uniform. This increases the chances of an anomaly developing at the interface of the plate and the coupling, thus compromising the integrity of the seal. Additionally, the sprinkler connection disclosed by Gaulin is difficult and time-consuming to service because a service provider must loosen individually each nut securing the mounting plate in place and must remove the nut and a corresponding washer in order to extract the sprinkler head from the duct.

With the above problems in mind, it is a general object of the present invention to provide a sprinkler head assembly and mounting system which is simple to manufacture and easy to service.

It is another object of the invention to provide a sprinkler head assembly and mounting system which requires minimal time for a service provider to inspect the sprinkler head.

It is yet another object of the present invention to provide a sprinkler head and mounting system having a construction which is suitable for use in the environment of a clean room where semiconductors are fabricated.

A still further object of the invention is to provide a sprinkler head assembly having a unitary construction which ensures the integrity thereof.

Yet another object of the invention is to provide a combination duct/extinguishing system having plural sprinkler head assembly and mounting systems meeting any and/or all of the above objects.

The invention achieves these and other objects in the form of a combination duct/extinguishing system which includes a duct and plural sprinkler head assembly and mounting systems on the duct. Each sprinkler head assembly and mounting system includes port structure mounted on the duct defining a passageway into an area internally of the duct, sprinkler head structure for each port structure having one end associated therewith and another end associated with an extinguishing media, and collar structure for removably engaging the port structure and the sprinkler head structure to fixedly hold the sprinkler head in the area internally of the duct.

These and additional objects and advantages of the present invention will be more readily understood after a consideration of the drawings and the detailed description of the preferred embodiment.

BRIEF DESCRIPTION OF THE DRAWINGS

FIG. 3 is an exploded pre-assembly view of one unit of the sprinkler head mounting system.

FIG. 4 is a top plan view of a mounting collar that forms a part of the present invention.

FIG. 5 is an isometric view of the mounting collar of FIG. 4.

DETAILED DESCRIPTION OF THE PREFERRED EMBODIMENT

Figure 1:
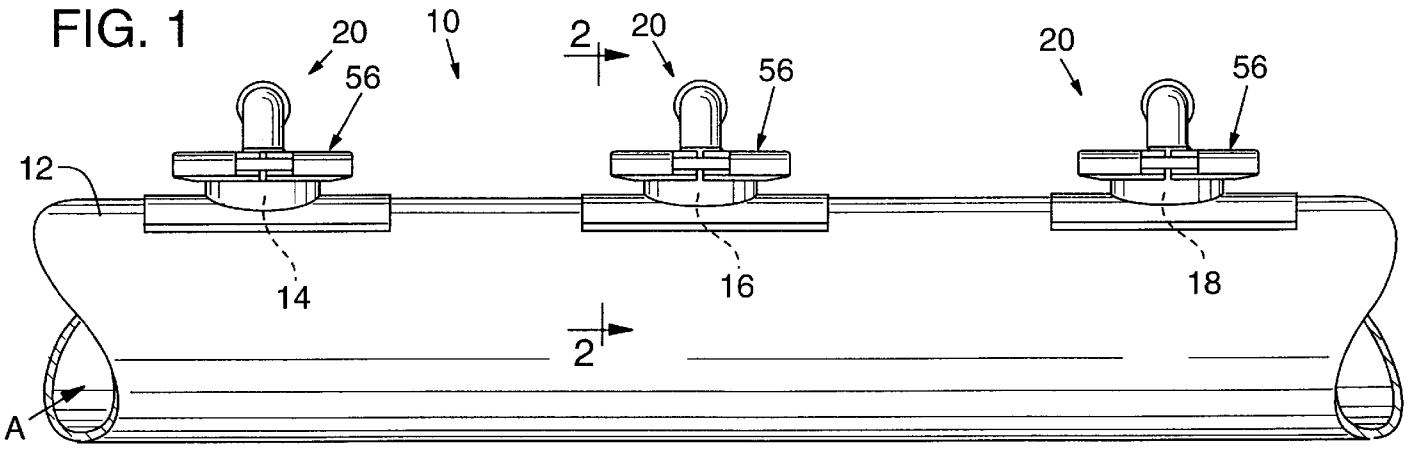
FIG. 1 is a lateral elevational view of the sprinkler head mounting system of the present invention made in accordance with its preferred embodiment.

As shown in FIG. 1, a combination duct/extinguishing system according to the present invention for conveying ignitable or combustible material is shown generally at 10, where it may be seen to include a duct 12 defining an enclosure or conduit for conveying the material, plural ports 14, 16, 18 for allowing access to an area A internally of the enclosure, and plural sprinkler head assembly and mounting systems indicated generally at 20. Hereinafter, combination duct/extinguishing system 10 will be referred to as the "extinguishing system," and sprinkler head assembly and mounting systems 20 will be referred to as the "mounting system," it being understood that each abbreviated name refers to the entire system from which the abbreviation is derived. It will be understood that mounting systems 20 in FIG. 1 are each identical and described by reference to FIGS. 2 through 5. Mounting system 20, as best shown in FIG. 2, may be seen to include port structure indicated generally at 22, operatively connected to and preferably mounted on duct 12 adjacent each port and defining a passageway 24 into area A.

Port structure 22 may be seen to include a base 26 which may be connected or joined to duct 12 by any suitable means. In the preferred embodiment, the base is connected by laminating it to the duct with a laminate consisting of the same material of which the duct is constructed which is a fiber-reinforced material. However, the base may be welded, screwed, bolted or suitably strapped on the duct depending on the material used to construct the duct. Moreover, although base 26 is depicted as being generally curved to conform to the curvature of duct 12, it will be appreciated that the base may be of any suitable shape such as flat, such shape being largely a function of the shape of the duct upon which it is mounted. That is, the base may be constructed to conform to any shape of duct. There may also be other mounting structures interposed between the base and the duct, effectively providing a mount for the base. A cylindrical sleeve 28 joined to base 26 defines a portion of passageway 24, and includes a generally circular flange 30 joined adjacent the top of sleeve 28.

Figure 2:
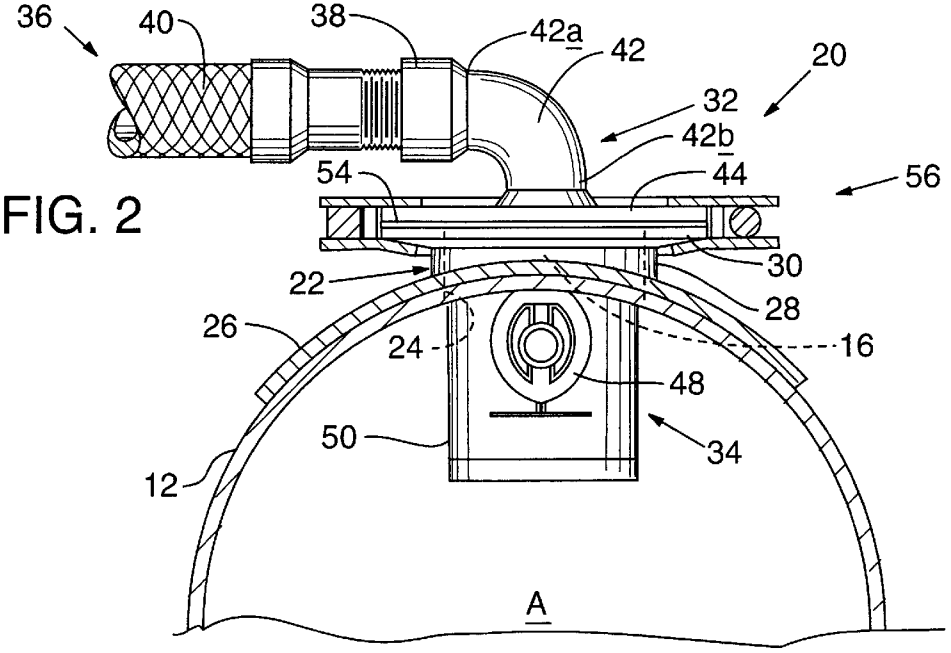
FIG. 2 is a fragmentary cross-sectional view of one unit of the sprinkler head mounting system taken generally along the lines 2—2 thereof.

Mounting system 20 also includes sprinkler head structure, indicated generally at 32 in FIGS. 2 and 3. Each port structure 22 has a corresponding sprinkler head structure operatively associated therewith. Each sprinkler head structure 32 has a first end 34 associated with a corresponding port structure, and a second end 36 suitably connected to an extinguishing medium, e.g. water. However, it will be appreciated that any suitable extinguishing media may be used depending on the nature of the material being conveyed through duct 12. As shown in FIG. 3, sprinkler head structure 32 includes an upper coupler 38 having a 1-inch diameter, suitably connected to a hose 40 which is preferably a stainless steel braided hose leading to a suitable extinguishing medium or fluid source. A neck 42 having a 1-inch diameter includes a first end 42*a* joined to upper coupler 38 and a second end 42*b* joined to a plate 44 which is preferably generally circular for a purpose described below. Plate 44 has a ½-inch diameter lower coupler 46 joined thereunder, which in turn has a sprinkler head 48 operatively connected thereon. It will be appreciated that couplers 38, 46 and neck 42 define a conduit through which fluid is passed so that sprinkler head 48 may, in the event the conveyed material in duct 12 ignites, communicate the extinguishing medium or fluid therethrough and into area A to extinguish the flames.

Preferably, couplers 38, 46, neck 42, and plate 44 are constructed of stainless steel and are welded together to define a generally unitary seamless body which is important insofar as one of the intended uses of the extinguishing system is in a clean room wherein semiconductors are manufactured. Such a construction, as will be understood by those of skill in the art, is important for it reduces the chances that moisture will cause corrosion on the exterior surfaces of the structure which could be catastrophic in such an environment. It will be understood that different materials may be used for construction depending on the environment in which the system will find use and that all of such constructions are within the spirit and scope of the invention. For example, the couplers, neck and plate may be constructed of carbon steel. Moreover, the couplers, neck and plate may be selectively detachable discrete components usable in settings which do not require the unitary construction described above. Such settings may include a duct attached to a hood for conveying grease away from a cooking area.

As shown in FIGS. 2 and 3, neck 42 includes a 90-degree elbow or bend. It will be appreciated that the neck may be configured to have any suitable bend, depending on access requirements to the mounting system and spacing restrictions therearound. For example, neck 42 may be configured to have a 45-degree elbow or may even be straight depending on the access requirements to the mounting system. Sprinkler head 48 is suitably enveloped in a protective plastic sheath 50 preferably constructed from polyethylene which provides protection against the corrosive environment in which the sprinkler head operates. FIG. 3 shows that sheath 50 surrounds sprinkler head 48 and extends upwardly and around plate 44. Further assurance against the corrosive effects of the operating environment is provided in the form of an additional protective sheath of wax coating 52 applied directly on sprinkler head 48 and lower coupler 46.

The sprinkler head and coupler may be coated multiple times to ensure that the wax surrounds the sprinkler head and coupler and that each is protected from the corrosive effects of the operating environment. In the event of a fire in the duct, the protective sheaths will melt away at a lower temperature than is required to activate the sprinkler head. It will be understood that different operating environments dictate different protective needs vis-a-vis the sprinkler head and that in some environments, such as the hood mentioned above, no protection may be necessary. One example of a different protective coating which has been found useful is a coating of Hetron 197-P for protecting against the effects of chlorine gas in the event such is conveyed by the duct.

Viton gasket 54 is provided and is interposed between plate 44 and flange 30, where it will be appreciated that when plate 44 is mounted on flange 30, gasket 54 presses sheath 50 against the underside of plate 44 and thereby forms a seal around sprinkler head 48. When combined with the seal provided by wax coating 52 around sprinkler head 48 and lower coupler 46, sheath 50 and gasket 54 provide a double seal which protects the sprinkler head and extends its useful life.

Collar structure, generally indicated at 56 in FIGS. 1, 2, 4 and 5 and associated with each port (see FIG. 1) removably engages port structure 22 and sprinkler head structure 32 to selectively, fixedly hold sprinkler head 48 in area A. More specifically, as shown in FIG. 4, collar structure 56 includes a first half 58 and a second half 60. In the preferred embodiment, the halves are suitably hinged together such as by a hinge 62. It will be appreciated however that any suitable means of clamping or latching the halves together will suffice. Moreover, the halves may be entirely separate from one another and latched, hitched, connected, or joined by any suitable means.

As shown in FIG. 5, each half includes wall structure which includes an upper wall 64 and a lower wall 66 joined thereto defining a generally annular groove 68. Groove 68 fixedly receives portions of flange 30 on port structure 22, and plate 44 on sprinkler head structure 32, to hold sprinkler head 48 in area A. Preferably, flange 30 and plate 44 are circular and groove 68 generally conforms therearound. It will be understood that the flange and plate (and hence the groove) may be any suitable shape such as square or rectangular.

As shown, hinge 62 provides a means for first and second halves 58, 60 to be selectively movable or pivotable between an open position for disengaging flange 30 and plate 44 so that sprinkler head 48 may be withdrawn through passageway 24, and a closed position for engaging flange 30 and plate 44 as described above. Halves 58, 60 may be constructed of any suitable material, although aluminum is preferable. In the preferred embodiment, flange 30 and plate 44 are circular (as evidenced by the annularity of groove 68 in FIG. 4). As mentioned above however, flange 30 and plate 44 may be any suitable shape and the shape of groove 68, and hence first and second halves 58, 60, may be adjusted accordingly.

As shown in FIGS. 4 and 5, a locking member 70 is pivotally connected to first half 58 and may be seen to include a screw 72 pivotally mounted on half 58, and a wing nut 74 selectively securable on screw 72 for securing or confining halves 58, 60 in the closed position. More specifically, as shown in FIG. 5, locking member 70 is pivotally mounted to a neck portion of first half 58 and may be pivoted so that when halves 58, 60 are in the closed position (FIG. 4), the threaded portion thereof lies between the upper and lower walls of the neck portion of second half 60 and extends far enough therefrom so that wing nut 74 may be threadedly advanced along screw 72 toward and against the neck portion of second half 60 selectively confining the second half, and hence the collar structure generally, in the closed position. It will be appreciated that any suitable confining, clamping, or latching means may be used for maintaining halves 58, 60 in the closed position.

Optionally, safety features may be provided for preventing wing nut 74 from being inadvertently loosened. Such features include but are not limited to a pin radially insertable into screw 72 adjacent wing nut 74 for preventing the wing nut from being loosened in the longitudinal direction along screw 72 and away from the neck of second half 60. Alternatively as shown in FIG. 5, a bore 74*a* in one of the wings of the wing nut may be made for receiving a safety wire 75 which is passed through an aperture 60*a* in the neck portion of half 60 and conventionally secured to prevent the nut from being loosened.

Operation

It will be appreciated that extinguishing system 10 and its plural mounting systems 20 provide a safe and conveniently serviceable system which, although described in the context of its use in a clean room used in semiconductor manufacturing, has many areas of application outside of such field. The invention as described above is particularly useful in any situation where frequent (or even infrequent) periodic servicing and inspection of the sprinkler head is required. Moreover, it is not necessary that the duct on which the mounting systems are employed convey caustic or corrosive agents.

One of the major advantages of the present invention, which should be readily evident from the above discussion, is the ease with which a service provider may inspect the sprinkler head. In order to inspect a chosen sprinkler head, collar structure 56 must be removed. In order to remove collar structure 56, a service provider need only unfasten any safety device (such as safety wire 75 in FIG. 5) preventing locking member 70, and more specifically wing nut 74, from being unloosened; manually unscrew wing nut 74; pivot screw 72 counter-clockwise to release the neck portion of second half 60; and pivot halves 58, 60 apart so that the collar structure may be removed. Now, by simply grasping hose 40 of sprinkler head structure 32 and pulling generally upwardly, sprinkler head 48 may be removed through passageway 24 to an area externally of the duct for inspection, after which it may be reinserted through passageway 24 and suitably secured by collar structure 56.

It will be appreciated that the above-described construction, in addition to being useful in clean room settings, greatly reduces the time required to inspect the sprinkler head and service the system.

While the particular embodiments discussed and shown hereinabove are fully capable of attaining the objects and advantages previously stated, it is to be understood that such are merely illustrative of the presently preferred embodiments of the invention, and that no limitations are intended to the details of construction or design herein shown other than as defined in the appended claims.

We claim:

1. A sprinkler head assembly and mounting system for selectively securing a sprinkler head within a duct conveying combustible agents comprising:

port structure mounted on the duct defining a passageway into an area internally of the duct;

sprinkler head structure having a first end associated with the port structure and a second end operatively connected to an extinguishing media, wherein the first end includes a sprinkler head for communicating the extinguishing media, and further wherein the first end is removably mountable on the port structure so that the sprinkler head extends into the area internally of the duct;

collar structure for removably engaging the port structure and the sprinkler head structure to fixedly hold the sprinkler head in the area internally of the duct; and a protective sheath surrounding the sprinkler head for protecting it from the flammable agents in the area internally of the duct wherein the protective sheath is a wax coating applied directly on the sprinkler head.

2. A sprinkler head assembly and mounting system for selectively securing a sprinkler head within a duct conveying combustible agents comprising:

port structure mounted on the duct defining a passageway into an area internally of the duct;

sprinkler head structure having a first end associated with the port structure and a second end operatively connected to an extinguishing media, wherein the first end includes a sprinkler head for communicating the extinguishing media, and further wherein the first end is removably mountable on the port structure so that the sprinkler head extends into the area internally of the duct;

collar structure for removably engaging the port structure and the sprinkler head structure to fixedly hold the sprinkler head in the area internally of the duct; and a protective sheath surrounding the sprinkler head for protecting it from the flammable agents in the area internally of the duct, wherein the protective sheath is a polyethylene bag enveloping the sprinkler head.

3. A sprinkler head assembly and mounting system for a duct conveying combustible agents comprising:

a hose connected to a fluid source;

an upper coupler connected to the hose;

a neck joined to the upper coupler;

a plate joined to the neck;

a lower coupler joined to the plate for receiving a sprinkler head;

port structure mounted on the duct defining a passageway into an area internally of the duct, wherein the structure includes a flange upon which the plate is selectively mountable; and a collar having first and second halves selectively movable between an open position and a closed position and securable in the closed position for fixing the plate on the flange.

4. The system of claim 3, wherein the upper coupler, neck, plate, and lower coupler define a generally unitary, seamless body constructed of stainless steel.

5. The system of claim 4, wherein the neck includes a generally 90-degree elbow.

6. The system of claim 4, wherein the neck includes a generally 45-degree elbow.

* * * * *